US011440082B2

(12) United States Patent
Del Fabro

(10) Patent No.: US 11,440,082 B2
(45) Date of Patent: Sep. 13, 2022

(54) APPARATUS AND METHOD TO MAKE A METAL MESH

(71) Applicant: M.E.P. MACCHINE ELETTRONICHE PIEGATRICI S.P.A., Reana del Rojale (IT)

(72) Inventor: Giorgio Del Fabro, Udine (IT)

(73) Assignee: M.E.P. MACCHINE ELETTRONICHE PIEGATRICI S.P.A., Reana del Rojale (IT)

( * ) Notice: Subject to any disclaimer, the term of this patent is extended or adjusted under 35 U.S.C. 154(b) by 248 days.

(21) Appl. No.: 16/479,727

(22) PCT Filed: Jan. 24, 2018

(86) PCT No.: PCT/EP2018/051657
§ 371 (c)(1),
(2) Date: Jul. 22, 2019

(87) PCT Pub. No.: WO2018/138117
PCT Pub. Date: Aug. 2, 2018

(65) Prior Publication Data

US 2021/0114081 A1 Apr. 22, 2021

(30) Foreign Application Priority Data

Jan. 24, 2017 (IT) ..... 102017000007565

(51) Int. Cl.
*B21F 27/10* (2006.01)
*B21F 23/00* (2006.01)

(52) U.S. Cl.
CPC ..... *B21F 27/10* (2013.01); *B21F 23/005* (2013.01)

(58) Field of Classification Search
CPC ..... B21F 27/00; B21F 27/08; B21F 27/10; B21F 15/02; B21F 15/06; B21F 15/08; B21F 23/00; B21F 23/005; B21D 43/14
(Continued)

(56) References Cited

U.S. PATENT DOCUMENTS 1,937,078 A 11/1933 Wickwire
2,712,837 A * 7/1955 Griesemer ..... B21F 27/10 140/112
(Continued)

FOREIGN PATENT DOCUMENTS

AU 2014100365 A4 * 5/2014
CN 105171263 A * 12/2015 ..... B21F 27/00
(Continued)

OTHER PUBLICATIONS

Int'l Search Report and Written Opinion dated Apr. 26, 2018 in Int'l Application No. PCT/EP2018/051657.

*Primary Examiner* — Shelley M Self
*Assistant Examiner* — Katie L. Parr
(74) *Attorney, Agent, or Firm* — Panitch Schwarze Belisario & Nadel LLP

(57) ABSTRACT

An apparatus to make a metal mesh having longitudinal rods and transverse rods which have a diameter and reciprocal pitch defined on each occasion according to requirements, is provided, having a first operating group and a second operating group disposed in sequence and functionally coordinated, to obtain a reticular semi-worked product that is completed to make the desired metal mesh.

8 Claims, 4 Drawing Sheets

(58) Field of Classification Search
USPC ..... 140/112
See application file for complete search history.

(56) References Cited

U.S. PATENT DOCUMENTS

| | | | | | |
|---|---|---|---|---|---|
| 4,667,707 | A * | 5/1987 | De Schutter | B21F 27/10 | 140/112 |
| 6,820,387 | B2 * | 11/2004 | Sacks | E04C 5/04 | 52/322 |
| 10,610,919 | B2 * | 4/2020 | Anagnostopoulos | B23K 11/008 | |
| 10,926,315 | B2 * | 2/2021 | Anagnostopoulos | B21F 27/10 | |
| 2012/0103460 | A1 * | 5/2012 | Anagnostopoulos | B21F 27/20 | 140/112 |

FOREIGN PATENT DOCUMENTS

| | | | | |
|---|---|---|---|---|
| EP | 2913119 | A1 * | 9/2015 | B21F 27/10 |
| KR | 20100020857 | A * | 2/2010 | |
| KR | 20160130933 | A * | 11/2016 | |
| WO | 2006/007612 | A1 | 1/2006 | |

* cited by examiner

APPARATUS AND METHOD TO MAKE A METAL MESH

CROSS-REFERENCE TO RELATED APPLICATIONS

This application is a Section 371 of International Application No. PCT/EP2018/051657, filed Jan. 24, 2018, which was published in the English language on Aug. 2, 2018, under International Publication No. WO 2018/138117 A1, which claims priority under 35 U.S.C. § 119(b) to Italian Application No. 102017000007565, filed Jan. 24, 2017, the disclosures of each of which are incorporated herein by reference in their entireties.

Embodiments of the present invention concern an apparatus to make a metal mesh which can be used, for example, as, or in association with, a reinforcement for reinforced concrete structures.

The metal mesh according to the present invention is defined by a plurality of rods, also known as "rebars" or "reinforcing bars", reciprocally welded to each other.

The rods can have cross section sizes, by way of example only, comprised between 3 mm and 30 mm, preferably between 4 mm and 26 mm.

The rods according to the present invention can also be the ribbed type, that is, they can be provided on their external surface with a plurality of surface irregularities or ribs, suitable to increase their adherence, for example, with the concrete.

The present invention can be used to obtain metal meshes with desired, homogeneous or differentiated mesh sizes.

One application of the present invention is to make metal meshes for reinforcement purposes, usable in the building trade for making metal structures to be incorporated in a concrete cast.

The present invention also concerns a method to make a metal mesh.

BACKGROUND OF THE INVENTION

Apparatuses to obtain metal meshes are known, for example for the building trade but not only, consisting of a plurality of metal rods, which are associated with each other longitudinally and transversely by electro-welding.

Known apparatuses, for example described in US-A-2012/0103460, usually have a first feed group configured to feed, substantially simultaneously, a plurality of longitudinal rods distanced from each other and a second feed group to provide, on each occasion and in the desired position, a rod transverse to the plurality of longitudinal rods.

These apparatuses also comprise at least one welding unit to weld the transverse rod on each occasion to the plurality of longitudinal rods in the zones of reciprocal overlap.

The reciprocal distance between the longitudinal rods is determined, on each occasion, by the reciprocal positioning of the individual feed units of the first feed group, which positioning is defined in an initial setting step of the apparatus.

However, these known solutions have numerous disadvantages, especially if it is desired to make very close meshes and/or with rods having different diameters that typically require an adaptation of at least the feed units to allow this supply.

In fact, it is known that it can also be very difficult to position the rods, since, in addition to not being stable, the individual rods require multiple repositioning depending on their length, reciprocal distance, diameter, etc.

In some cases, to simplify, longitudinal and/or transverse rods are taken from warehouses where they are already present, straightened and cut to size.

This solution applies only in the case of production of metal meshes having the same identical characteristics in very large series.

Furthermore, in order to cope with variables present in the production batches of metal meshes, each individual longitudinal rod provided in the metal mesh provides for an autonomous feed that comprises at least one coil, a straightening member, a shear and means to control the length.

This entails problems of maintenance, storage and considerable bulk and hence investment in terms of buildings. Moreover, these known solutions require complex equipment and entail considerable equipment downtimes in the event of a change-in-format of the metal mesh to be obtained.

It is also known that the minimum pitch between two longitudinal rods is conditioned by the bulk of the individual feed units.

Moreover, when it is desired to modify the format of the metal meshes to be made, complex and expensive operations of reciprocal repositioning of the individual feed units of the first feed group are necessary.

This operation can be repeated many times during a working day, and involves waste of time and energy due to the interruption of production required by the repositioning.

It is also known that the rods of electro-welded meshes have to be supplied to the welding units already linearized, and cannot be subjected, during the welding operations, to bending or curving such as to compromise their shape. In fact, any bending of the rods during the process would not allow to obtain a metal mesh with correct and regular sizes.

A machine is also known for the production of electro-welded meshes described in document U.S. Pat. No. 2,712,837.

The electro-welded meshes that can be obtained with this known machine are defined by metal wires, of limited diameter, for example about 1 mm, and in any case less than 2 mm, which can also be moved and bent to follow desired curved paths needed by the particular conformation of the machine, or the disposition of the operating components.

The machine consists of a first feeder that continuously feeds a plurality of first longitudinal wires to a first roller-type welding unit. In correspondence with the first welding unit a feed unit is installed to feed transverse wires, which comprises a rotating drum provided with a plurality of longitudinal seatings suitable to house the transverse wires and supply them, on each occasion, by rotation of the drum, in correspondence to the first welding unit.

The longitudinal seatings are positioned, during use, transverse to the longitudinal development of the first longitudinal wires.

To allow a correct welding of the first longitudinal wires and of the transverse wires, the first longitudinal wires are obliged to wind at least partly around the rotating drum and, in a condition of tangency of the first longitudinal wires and of the transverse wires, welding is carried out.

Downstream of the first welding unit, a second feeder is provided which feeds, also substantially continuously, a plurality of second longitudinal wires, to the transverse wires.

The second longitudinal wires are parallel and interposed to the first longitudinal wires and are fed toward the latter in a direction transverse and incident to the lying plane of the first longitudinal wires and of the already welded transverse wires.

In the zone of incidence of the planes, the transverse wires are welded to the second longitudinal wires by means of a second welding unit.

However, this welding machine belongs to a field of application completely different from that of the present invention. With this known machine, metal meshes are obtained defined by very small wires, whereas the machines to which the present invention refers process metal rods having very large diameters. In this known machine there is a high flexibility of disposition of the machine components, and a bending or shaping of the metal wires, necessitated by following a predetermined curved path, does not compromise the correct production of the metal mesh.

This type of known machine, in fact, cannot be used to process metal reinforcement rods, since a bending and/or curvature of the metal rods intended to make the mesh is irreversible and leads to the production of incorrect metal meshes.

There is therefore a need to perfect and make available an apparatus and a method to make a metal mesh which overcomes at least one of the disadvantages of the prior art.

The present invention also sets itself the purpose to provide an apparatus to make metal meshes which does not limit or condition the positioning of at least the longitudinal rods.

Another purpose of the present invention is to provide an apparatus able to make metal meshes whose distances, at least between the longitudinal rods, have equal and/or different values, and predetermined on each occasion.

Another purpose of the present invention is to make an efficient apparatus which allows to reduce and possibly cancel the setting and stop times of the apparatus, also during a change-of-format of the metal mesh.

Another purpose is to provide an apparatus which has a limited number of components to obtain metal meshes with any type of mesh size, reducing the problems of maintenance and supply of spare parts.

The present invention also sets out to provide a method to make metal meshes quickly and with mesh sizes that are defined on each occasion, and also variable for a limited number of metal meshes produced.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

Embodiments described here concern an apparatus to make a metal mesh defined by longitudinal rods and transverse rods which have a diameter and reciprocal pitch defined on each occasion according to requirements. In some embodiments, the apparatus comprises two operating groups disposed in sequence and functionally coordinated, the first operating group configured to obtain a reticular semi-worked product comprising at least two first longitudinal rods welded to a complete plurality of transverse rods with a desired pitch, and the second operating group being configured to weld to the reticular semi-worked product second longitudinal rods with a desired pitch in order to complete the reticular semi-worked product and to obtain the metal mesh.

According to possible embodiments of the invention, the apparatus to make a metal mesh comprises:

- a first feed group configured to feed in first directions at least two first longitudinal rods lying on a first feed plane;
- a second feed group configured to feed in a second direction, transverse to the first directions, on each occasion a transverse rod lying on a second feed plane parallel to the first feed plane;
- a first welding unit configured to weld on each occasion to said first longitudinal rods the transverse rod fed by the second feed group and to obtain a reticular semi-worked product.

According to one aspect of the present invention, the apparatus comprises:

- a third feed group configured to feed on each occasion a second longitudinal rod lying on a third feed plane parallel to the second feed plane and positioning it during use parallel to said first longitudinal rods of the reticular semi-worked product; and
- a second welding unit to weld on each occasion the second longitudinal rod to the transverse rods of the reticular semi-worked product.

According to possible embodiments, the first and second operating group are located with their respective axes of advance angled, advantageously orthogonal, or in any case positioned according to the longitudinal axes of the longitudinal rods with respect to the transverse rods.

According to another variant, the first and second operating group are located sequential and substantially on the same axis or on angled axes, a rotation and positioning member of the reticular semi-worked product being provided between the two operating groups.

It is within the spirit of the invention that there is at least a control and command unit configured to command at least one of either the first operating group or the second operating group, or their parts.

According to a variant, the control and command unit operates in a coordinated manner on the two operating groups in order to make, on each occasion, a metal mesh with links of the desired size and/or rods with lengths and/or desired diameters.

According to the present invention, the control and command unit is programmable.

According to possible embodiments, at least one of either the longitudinal rods or the transverse rods can be fed with rods that have been pre-sized to size, or defined by segments of a predetermined length.

According to other variants, at least one of either the longitudinal rods or the transverse rods can be fed with rods arriving from a coil.

According to possible formulations, the present invention also concerns a method to make metal meshes.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
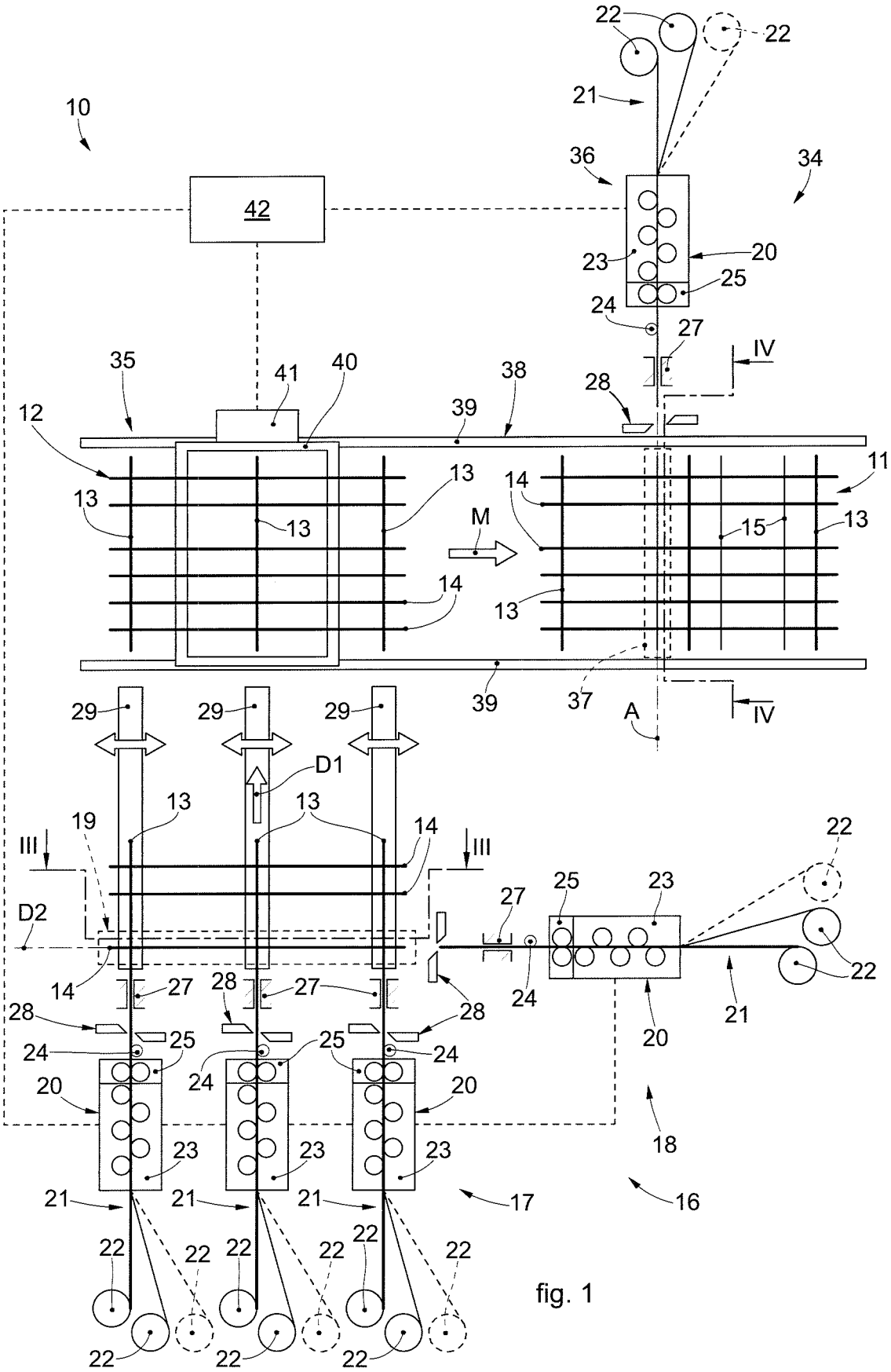
FIG. 1 is a schematic representation of an apparatus to make a metal mesh according to a possible embodiment of the present invention.

Embodiments described here, with reference to the drawings, concern an apparatus to make a metal mesh 11.

The metal mesh 11 is defined by longitudinal rods 13 and 15 and transverse rods 14. The rods 13, 14, 15 can have a diameter D and a reciprocal pitch P which can be fixed or different, said characteristics being defined according to the operating needs of the metal mesh 11.

The rods, whether they are longitudinal 13 and 15 or transverse 14, can have a round cross section, or square, rectangular or oval etc.

According to possible embodiments the rods 13, 14 and 15 can be provided on their surface with anchoring ribs to obtain a better grip with the concrete.

The transverse rods 14 are welded with the first and second longitudinal rods 13 and 15, for example electro-welded in correspondence with the zones of reciprocal overlap.

According to possible embodiments, the apparatus 10 comprises a first operating group 16 and a second operating group 34, disposed in sequence, that is, in series, and functionally coordinated with each other.

By disposed in sequence, we mean that the first operating group 16 provides, on each occasion, a reticular semi-worked product 12 to the second operating group 34 to complete it and form a metal mesh 11.

The reticular semi-worked product 12 acts as a base frame and is defined by the transverse rods 14 welded to at least two first longitudinal rods 13 located in the desired position. The reticular semi-worked product 12 thus obtained is then completed with second longitudinal rods 15 to form a metal mesh 11.

The second longitudinal rods 15 are disposed substantially parallel to the first longitudinal rods 13, and can be interposed between them.

The transverse rods 14 present in the reticular semi-worked product 12 act as stabilizers of the reticular semi-worked product 12 itself, for the subsequent application of the second longitudinal rods 15.

In accordance with possible embodiments, the first operating group 16 can comprise a first feed group 17 configured to feed the at least two first longitudinal rods 13 for a predefined length in respective first directions D1, parallel to each other.

According to possible embodiments, the first feed group 17 is configured to feed the at least two first longitudinal rods 13 on a first lying plane P1.

According to one embodiment of the invention, the first feed group 17 is also configured to move the first longitudinal rods 13 at a desired and controlled pitch in said first direction D1.

This step-wise feed, which takes place in the first direction D1, also defines the axis of advance of the reticular semi-worked product 12 in formation in the first operating group 16.

The first operating group 16 also comprises a second feed group 18, configured to feed in a second direction D2, transverse to the first direction D1, on each occasion a transverse rod 14, lying on a second feed plane P2, parallel to the first feed plane P.

The first feed plane P1 and the second feed plane P2 can be reciprocally distanced from each other by a distance sufficient to allow to position the first longitudinal rods 13 above the transverse rods 14.

According to a possible solution of the invention, the second feed group 18 is configured to move one of the transverse rods 14 linearly and on each occasion, in order to position it above or below the first longitudinal rods 13. In particular, it is provided that the second feed group 18 moves the transverse rods 14 linearly in a direction parallel to their oblong development.

The second feed group 18 can operate orthogonally, or at another desired angle, with respect to the first feed unit 17, and is configured to feed individual transverse rods 14 for a predefined length on each occasion and with every feed step of the first longitudinal rods 13.

According to an advantageous solution, the directions D1 and D2 are disposed at 90° with respect to each other.

The first operating group 16 also comprises a first welding unit 19 configured to weld, on each occasion, the transverse rod 14 fed by the second feed group 18 to the first longitudinal rods 13 and obtain the reticular semi-worked product 12.

According to a possible solution, the first welding unit 19 is positioned in, that is, it extends in a direction parallel to the second direction D2 to weld at each step, and at each feed of the individual transverse rod 14, the first longitudinal rods 13 to transverse rods 14 to obtain the reticular semi-worked product 12.

According to another embodiment of the invention, the second feed group 18 is disposed at one end of the first welding unit 19 and is configured to insert, on each occasion, a transverse rod 14 in the first welding unit 19 in the second direction D2.

According to a possible embodiment of the present invention, the second operating group 34 comprises a reception and movement unit 35 configured to receive and feed, at a controlled and desired pitch, the reticular semi-worked product 12 along a movement axis M located, during use, substantially parallel to the longitudinal axis of the transverse rods 14.

In particular, it can be provided that the reception and movement unit 35 is configured to receive the reticular semi-worked product 12 from the first welding unit 19 and move it toward the second welding unit 37.

In accordance with possible solutions of the present invention, the reception and movement unit 35 defines a support plane for the reticular semi-worked product 12 which can be located substantially parallel to the first feed plane P1 and to the second feed plane P2. This prevents, during the movement, the reticular semi-worked product 12 from being subjected to unwanted flection or bending which can compromise the quality of the final metal mesh to be obtained.

The second operating group 34 also comprises a third feed group 36 configured to feed, on each occasion, a second longitudinal rod 15 lying on a third feed plane P3 parallel to the second feed plane P2 and position it, during use, parallel to the first longitudinal rods 13 of the reticular semi-worked product 12.

In accordance with a possible solution, the third feed group 36 is configured to move linearly along an axis of feed A, on each occasion, one of the second longitudinal rods 15 to the second welding unit 37. The third feed group 36 can linearly move the second longitudinal rods 15 in a direction parallel to their longitudinal development.

Figure 5:
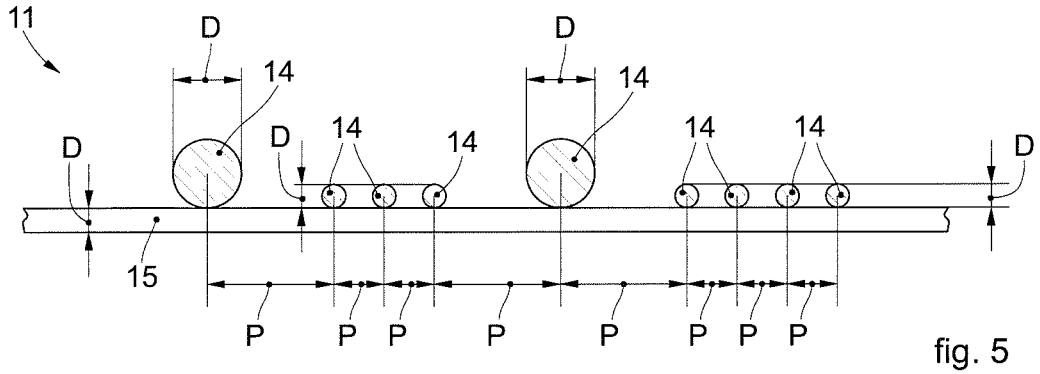
FIG. 5 is a schematic view of a possible metal mesh which can be made using an apparatus according to a possible embodiment of the present invention.
Figure 6:
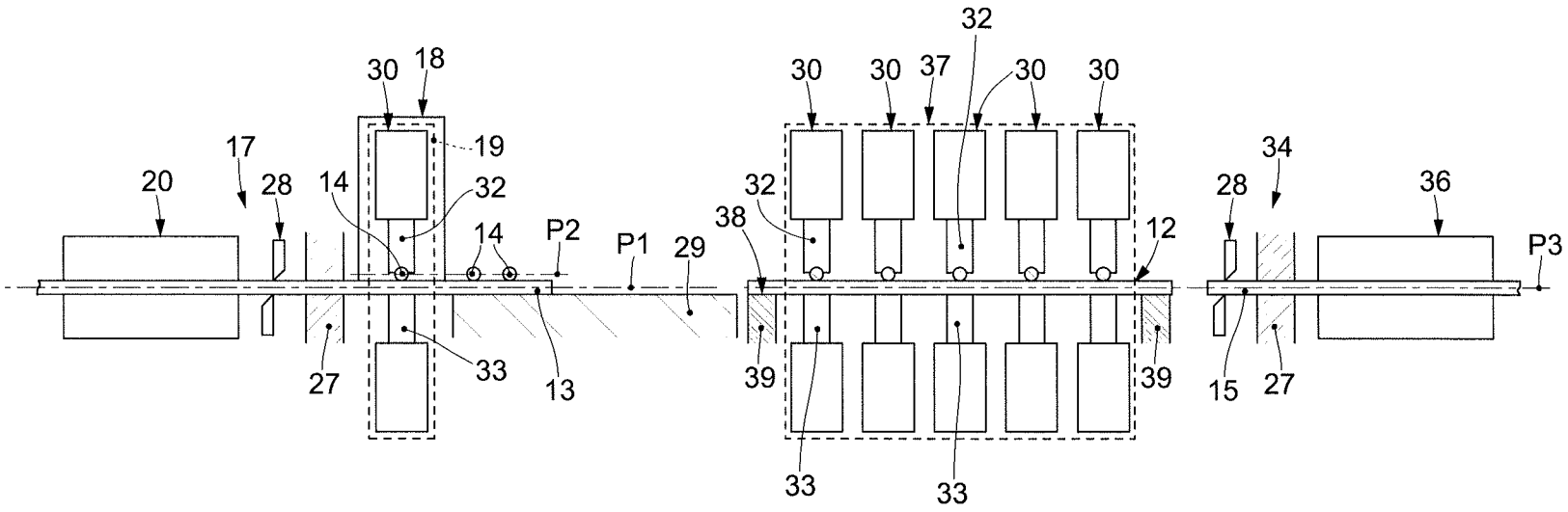
FIG. 6 is a lateral view of FIG. 1.

In accordance with a possible solution of the invention, the second longitudinal rod can be provided, with respect to the transverse rods 14, on the same side, or on the same plane, in which the first longitudinal rods 15 are present (as shown in FIG. 5) or, alternatively, on the opposite side.

According to some solutions, the third feed group 36 is configured to feed, with every movement step of the reticular semi-worked product 12, a single second longitudinal rod 15 for a predefined length.

The feed takes place along an axis of feed A angled at a desired angle, advantageously but not exclusively 90° or orthogonal with respect to the movement axis M.

The second operating group 34 also comprises a second welding unit 37 configured to weld, on each occasion, one of the second longitudinal rods 15 to the transverse rods 14 which are already previously welded to the at least two first longitudinal rods 13.

The second welding unit 37 operates in a coordinated manner with the third feed group 36, and carries out the welding of a second longitudinal rod 15 at each movement step of the reticular semi-worked product 12 to obtain a desired metal mesh 11.

According to a possible solution, the second welding unit 37 is positioned along, that is, it extends in a direction parallel to the axis of feed A to weld at each movement step of the reticular semi-worked product 12, and at each feed of the single second longitudinal rod 15, the second longitudinal rod 15 to the transverse rods 14 to obtain the metal mesh 11.

According to another embodiment of the invention, the third feed group 36 is disposed at one end of the second welding unit 37 and is configured to insert, on each occasion, a second longitudinal rod 15 into the second welding unit 37 along the axis of feed A.

According to a possible embodiment, the first feed group 17 defines an axis of advance of the reticular semi-worked product 12 which is parallel to the first direction D1.

In accordance with the embodiment shown in FIG. 1, the axes of advance of the first operating group 16 and of the second operating group 34 are angled with each other, for example comprised between 60° and 120°, in this case by 90°.

In FIG. 1, the movement axis M of the second operating group 34 is substantially parallel to the second feed direction D2 of the transverse rods 14.

According to an advantageous variant, the first direction D1 and the movement axis M are positioned respectively like the longitudinal axis of the first longitudinal rods 13 and the longitudinal axis of the transverse rods 14.

Figure 2:
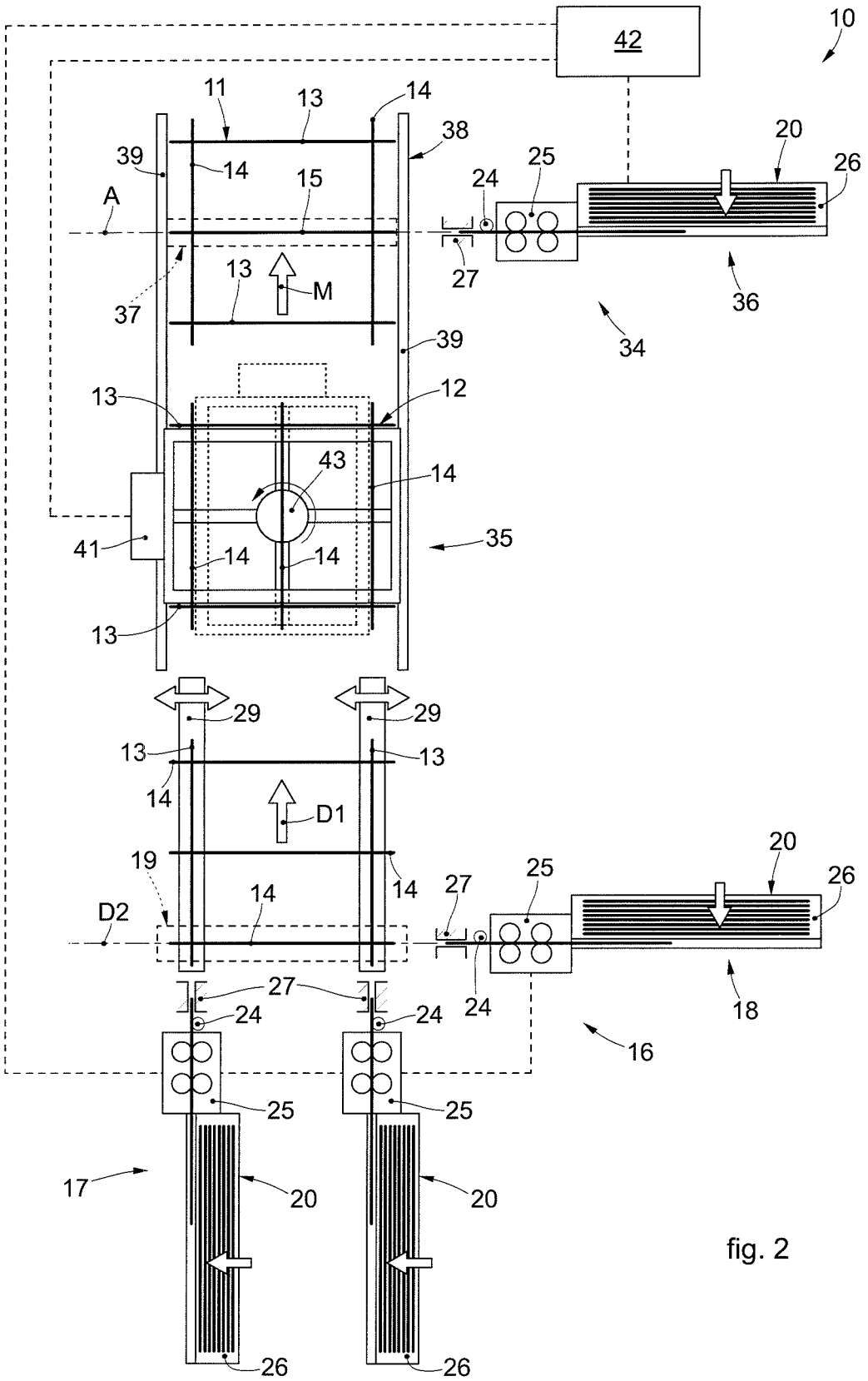
FIG. 2 is a schematic representation of another apparatus to make a metal mesh
Figure 3:
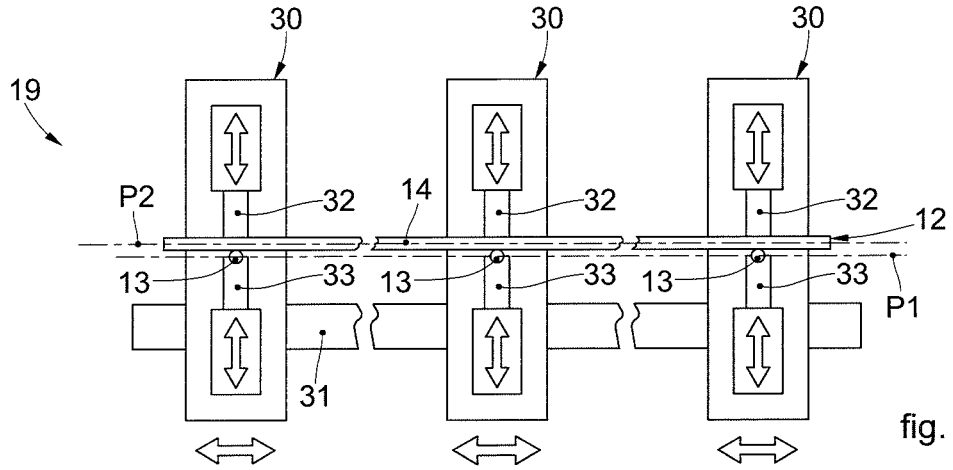
FIGS. 3 and 4 are two sections views respectively along the section lines III-III and IV-IV of FIG. 1.
Figure 4:
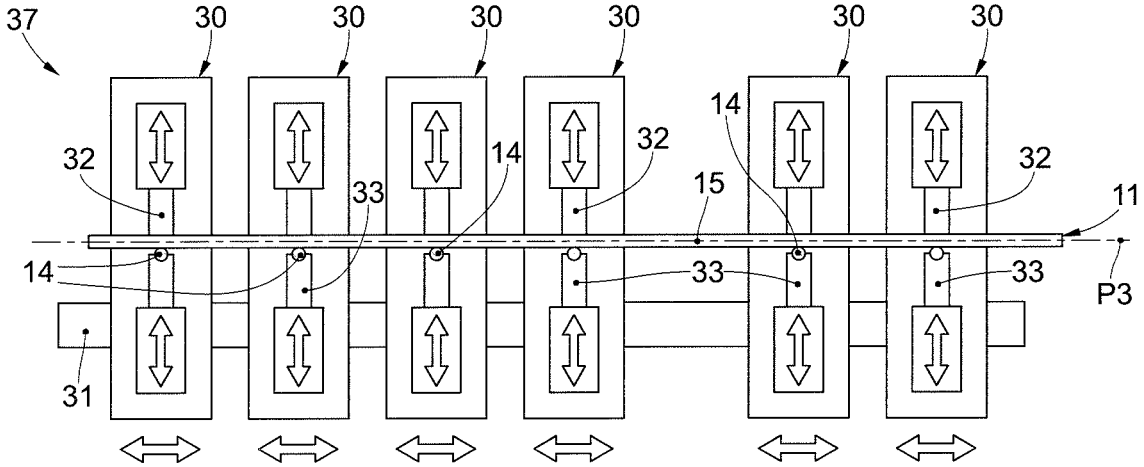

According to possible variants (see FIG. 2), the first and second operating groups 16 and 34 are located sequential and substantially aligned on the same axis of advance. According to this variant embodiment, the first direction D1 is parallel to the movement axis M.

In accordance with this variant embodiment, between the first welding unit and the reception and movement unit 35 a rotation and positioning member 43 is interposed, configured to rotate the reticular semi-worked product 12. The rotation and positioning member 43 is configured to rotate the reticular semi-worked product 12 keeping it parallel to the first feed plane P1.

According to a possible solution, the rotation and positioning member 43 is configured to rotate the reticular semi-worked product 12 so as to dispose the first longitudinal rods 13 substantially parallel to the second direction D2.

According to one embodiment of the present invention, the first feed group 17 comprises a plurality of feed units 20 to feed the first longitudinal rods 13.

According to another embodiment of the present invention, the second feed group 18 comprises a feed unit 20 to supply the transverse rods 14.

In the second operating group 34, the third feed group 36 comprises a feed unit 20 which supplies the second longitudinal rods 15.

The feed units 20 can comprise a feed member 21 configured to feed, on each occasion, a single rod having a desired diameter.

The feed member 21 can comprise at least one of, or a combination of, a coil 22 to supply metal rods, a straightening member 23 for the rods, a drawing member 25, a guide member 27, a shearing member 28 and measuring means 24 to measure the length of the rod fed.

According to possible embodiments (see FIG. 2), at least one of either the longitudinal rods 13 and 15 or the transverse rods 14 can be fed from stores 26 with pre-sized rods, already straightened, to the required size, or supplied in the form of segments with a predetermined length.

According to possible embodiments, the first feed group 17 can advantageously comprise only two feed units 20, since this number of feed units 20 is the minimum number required to produce a reticular semi-worked product 12.

This configuration has the advantage of considerably reducing the number of feed units 20 usually used in known solutions.

According to possible embodiments, downstream of the individual feed units 20 there can be support members 29 able to support the individual rods fed.

The support members 29 define a support and movement plane for the reticular semi-worked product 12 which is formed in the first operating group 16. The support and movement plane can be substantially parallel to the first feed plane P1 and to the second feed plane P2.

Depending on the feed pitch of the first longitudinal rods 13 in the first direction D and the frequency with which the transverse rods 14 are supplied, the interaxis between the transverse rods 14 is defined on each occasion.

In the first operating group 16, the welding unit 19 comprises at least two welding members 30 configured to weld on each occasion, for example by electro-welding, the first longitudinal rods 13 to the transverse rods 14.

In the second operating group 34, the welding device 37 comprises a plurality of welding members 30 to weld on each occasion, for example by electro-welding, the second longitudinal rods 15 to the reticular semi-worked product 12.

Each welding member 30 can be positioned in correspondence with one of the reciprocal overlapping zones of the respective rods. For example, the welding members can be moved by suitable actuators along a positioning guide 31, parallel to the second direction D2, for those of the first welding unit 19, or parallel to the axis of feed A, for those of the second welding unit 37. The actuators are configured to position the welding members in the desired positions along the positioning guide 31 on each occasion and according to the desired mesh sizes.

According to possible embodiments, each welding member 30 can comprise a first electrode 32 and a second electrode 33 opposite each other with respect to the zones of reciprocal overlapping of the first longitudinal rod 13 and the transverse rod 14.

The first and second electrode 32 and 33 can be electrically powered by an electric power generator, not shown, to apply the energy necessary for welding to the first longitudinal rods 13 and the transverse rods 14.

At least one of either the first electrode 32 or the second electrode 33 can be selectively movable between a first position, in which the two electrodes 32 and 33 are distanced from each other, defining a gap where the rods to be welded can be put, and a second welding position, in which the two electrodes 32 and 33 clamp and weld the rods.

According to possible embodiments, the reception and movement unit 35 of the second operating group 34 can comprise a guide device 38 disposed angled, or advantageously orthogonal, to the first direction D1.

According to possible embodiments, which can be combined with other embodiments described, the guide device 38 is disposed substantially parallel, or aligned, to the first direction D1.

The guide device 38 defines the movement axis M of the second operating group 34.

According to possible embodiments, the guide device 38 can comprise one or more guide elements 39 aligned in a direction parallel to the movement axis M.

In accordance with possible embodiments (FIG. 1), the reception and movement unit can comprise a movement member 40, such as a slider or other similar member, able to receive the reticular semi-worked product 12 from the first operating group 16 to move it along the movement axis M defined by the guide device 38.

According to possible embodiments, the movement member 40 can also be configured to rotate so as to orient the reticular semi-worked product 12 in the desired manner and then move it along the movement axis M defined by the guide device 38.

According to possible embodiments, the reception and movement unit 35 can comprise a control device 41 configured to drive the movement member 40 in a controlled manner and with the pitch desired on each occasion along the movement axis M.

The controlled movement of the movement member 40 is carried out at desired pitches according to the interaxis to be obtained between the second longitudinal rods 15.

In accordance with possible embodiments, the apparatus 10 can comprise a control and command unit 42 configured to command at least one of either the first operating group 16 or the second operating group 34, or parts thereof.

In accordance with possible embodiments, the control and command unit 42 can be configured to control and command the feed units 20 and the reception and movement unit 35 in a coordinated manner to make metal meshes 11 having the desired mesh sizes on each occasion.

In particular, the control and command unit 42 can comprise, for example, a microcontroller, a programmable electronic circuit, or any similar unit, which allows to manage the functioning of the components of the apparatus 10.

According to possible formulations, the present invention also concerns a method to make a metal mesh 11 which provides to:

feed, in first directions D1, at least two first longitudinal rods 13 lying on a first feed plane P1 and by means of a first feed group 17;

feed, in a second direction D2 transverse to the first directions D1, on each occasion, a transverse rod 14 lying on the second feed plane P2, parallel to the first feed plane P1, by means of a second feed group 18;

weld the transverse rod 14 to the first longitudinal rods 13 by means of the first welding unit 19 to obtain a reticular semi-worked product 12, feed with the third feed group 36, on each occasion, a second longitudinal rod 15, lying on the third feed plane P3, parallel to the second feed plane P2 and positioned during use parallel to said first longitudinal rods 13 of the reticular semi-worked product 12;

weld, with the second welding unit 37, on each occasion the second longitudinal rod to the transverse rods 14.

According to possible embodiments of the present invention, when rods with the same diameter D are used, it is possible to vary the length and/or disposition of the rods also during processing, so as to proceed without discontinuities.

It is clear that modifications and/or additions of parts can be made to the apparatus to make metal meshes 11 as described heretofore, without departing from the field and scope of the present invention.

It is also clear that, although the present invention has been described with reference to some specific examples, a person of skill in the art shall certainly be able to achieve many other equivalent forms of the apparatus 10, having the characteristics as set forth in the claims and hence all coming within the field of protection defined thereby.

The invention claimed is:

1. An apparatus to make a metal mesh (11), said apparatus comprising:

a first feed group (17) configured to feed in first directions (D1) at least two first longitudinal rods (13) lying on a first feed plane (P1);

a second feed group (18) configured to feed in a second direction (D2), transverse to the first directions (D1), a transverse rod (14) lying on a second feed plane (P2) parallel to said first feed plane (P1);

a first welding unit (19) configured to weld the transverse rod (14) to said first longitudinal rods (13) to obtain a reticular semi-worked product (12);

a third feed group (36) configured to feed a second longitudinal rod (15) lying on a third feed plane (P3) parallel to said second feed plane (P2) and parallel to said first longitudinal rods (13) of said reticular semi-worked product (12);

a second welding unit (37) configured to weld the second longitudinal rod to said transverse rods (14); and a reception and movement unit (35) configured to receive said reticular semi-worked product (12) from said first welding unit (19) and to move it, along a movement axis (M), toward said second welding unit (37), said reception and movement unit (35) defining a support plane for said reticular semi-worked product (12) which is located parallel to said first feed plane (P1) and said second feed plane (P2), wherein between said first welding unit (19) and said reception and movement unit (35) a rotation and positioning member (43) is interposed, configured to rotate said reticular semi-worked product (12).

2. The apparatus as in claim 1, wherein said second feed group (18) is configured to move linearly one of said transverse rods (14).

3. The apparatus as in claim 2, wherein said first welding unit (19) is positioned along, and extends in a direction parallel to, said second direction (D2), and wherein said second feed group (18) is disposed at one end of the first welding unit (19) and is configured to insert a transverse rod (14) into the first welding unit (19).

4. The apparatus as in claim 1, wherein said third feed group (36) is configured to move said second longitudinal rod (15) linearly along an axis of feed (A) to the second welding unit (37).

5. The apparatus as in claim 4, wherein said second welding unit (37) is positioned along, and extends in a direction parallel to, said axis of feed (A), and wherein said third feed group (36) is disposed at one end of said second welding unit (37) and is configured to insert said second longitudinal rod (15) into the second welding unit (37) along said axis of feed (A).

6. The apparatus as in claim 1, wherein at least one of either said longitudinal rods (13, 15) or said transverse rods (14) is fed from stores (26) with rods that are pre-sized, already straightened and cut to size.

7. The apparatus as in claim 1, wherein at least one of either said longitudinal rods (13, 15) or said transverse rods (14) is fed with rods coming from a coil (22).

8. A method to make a metal mesh (11) which comprises:

feeding in first directions (D1), via a first feed group (17), at least two first longitudinal rods (13) lying on a first feed plane (P1);

feeding in a second direction (D2) transverse to the first directions (D1), via a second feed group (18), a transverse rod (14) lying on a second feed plane (P2), parallel to said first feed plane (P1);

welding, via a first welding unit (19), said transverse rod (14) to said first longitudinal rods (13) to obtain a reticular semi-worked product (12);

feeding, via a third feed group (36), a second longitudinal rod (15) into an intermediate position between said first longitudinal rods (13) and on a third feed plane (P3), parallel to the second feed plane (P2) and parallel to said first longitudinal rods (13) of the reticular semi-worked product (12);

rotating said reticular semi-worked product (12), via a rotation and positioning member (43) interposed between the first welding unit (19) and a reception and movement unit (35);

receiving, via the reception and movement unit (35), said reticular semi-worked product (12) and moving said reticular semi-worked product (12) along a movement axis (M) toward a second welding unit (37), said reception and movement unit (35) defining a support plane for said reticular semi-worked product (12) which is located parallel to said first feed plane (P1) and said second feed plane (P2); and welding, via the second welding unit (37), the second longitudinal rods (15) to said transverse rods (14).

* * * * *